US006241368B1

(12) United States Patent
Depino

(10) Patent No.: US 6,241,368 B1
(45) Date of Patent: Jun. 5, 2001

(54) ELECTRICAL LIGHT FIXTURE ASSEMBLY

(76) Inventor: Gerald Carl Depino, 34056 Cane Market Rd., Walker, LA (US) 70785

( * ) Notice: Subject to any disclaimer, the term of this patent is extended or adjusted under 35 U.S.C. 154(b) by 0 days.

(21) Appl. No.: 09/398,309

(22) Filed: Sep. 20, 1999

(51) Int. Cl.[7] ..... F21V 21/04

(52) U.S. Cl. ..... 362/364; 362/147; 362/365

(58) Field of Search ..... 362/147, 364, 362/365, 366, 371, 404, 368

(56) References Cited

U.S. PATENT DOCUMENTS 4,048,491 * 9/1977 Wessman ..... 362/364
5,931,432 * 8/1999 Herold et al. ..... 362/365
5,964,523 * 10/1999 Eversberg ..... 362/365

* cited by examiner

*Primary Examiner*—Y. Quach
(74) *Attorney, Agent, or Firm*—Richard J. Hammond

(57) ABSTRACT

An electrical light fixture assembly for attachment to a mounting panel having a front surface, a back surface and an installation hole formed therethrough. The assembly comprises a housing including a base having a rearwardly facing surface and having at least one knockout disc formed therein and a sidewall extending forwardly of the base to define a hollow enclosure having a front opening. When the housing is inserted into the installation opening, the rearwardly facing surface of the base of said housing is in substantially the same plane as the back surface of the mounting panel. A plurality of tab members extend outwardly from the sidewall, the tab members being adjacent to the front opening of the hollow enclosure and engage the front surface of the mounting panel, thus limiting the entry of the housing through the installation hole of the panel. A stop member is secured to the base for limiting the degree of rotation of an at least one clamp member. A rotatable shaft member, accessible from the front of the housing, rotates the at least one clamp member which is secured to the rotatable shaft member that extends rearwardly of the rearward facing surface of the base. When the rotatable shaft member is rotated, such rotation causes the at least one clamp member to also rotate and thus engage the back surface of the mounting panel, thereby securing the housing to the mounting panel. Continued rotation of the at least one clamp member is limited by the stop member, which prevents the at least one clamping member from further rotation which would disengage it from the back panel.

6 Claims, 3 Drawing Sheets

ELECTRICAL LIGHT FIXTURE ASSEMBLY

FIELD OF THE INVENTION

This invention relates to an electrical light fixture assembly which can be mounted within an opening of a panel, having a front surface and a back surface, in a wall or ceiling where such opening is blocked by a stud, pipe or other construction member typically in close proximity to the back surface of the panel. More particularly, this invention relates to an electrical light fixture assembly having a base and a side wall, the base and side wall having a thickness substantially equal to the thickness of the wall or ceiling panel in which it is mounted, and extending thru the base, at least one rotatable clamping arm for engaging the back surface of the wall or ceiling panel, the back surface of the panel being located in the substantially the same plane as the rearward facing surface of the base of the electrical light fixture assembly.

BACKGROUND OF THE INVENTION

To conveniently support an electrical fixture, such as a ceiling fan, electrical lighting fixture and the like, an electrical light fixture assembly that contains the electrical wiring, cables, etc. is necessary. Typically, the assembly is mounted in an opening of a wall or ceiling panel and secured in the opening by mounting screws attaching it to the exterior wall surface. In some cases the assembly is secured in the opening by screws attaching it to a stud or plate in the interior portion of the wall or ceiling. See, for example, U.S. Pat. No. 4,399,922 to Horsley.

More recently, electrical assemblies have been secured within the ceiling or wall openings via pivotal arms where one arm is mounted on a comer of each of the top and bottom end walls of the assembly diagonally opposite from each other. The electrical light fixture is then secured to the assembly by threading screws within bosses formed in the assembly.

U.S. Pat. No. 4,297,525 to Bowden discloses an electrical outlet box having a pawl mounting assembly which includes a pawl clamping arm. According to this invention, the pawl clamping arm is adapted to be rotated between retracted and extended positions and to travel in a linear direction in the extended position into and out of clamping engagement with the interior side of the wall opening in which it is mounted.

In U.S. Pat. No. 5,434,359 to Schnell an electrical box is disclosed that may be mounted in a rectangular opening of a wall surface. The box has rotatable securing arms that after moving axially along screws can be brought into contact with the interior surface of the wall or ceiling panel, thereby preventing the box from being pulled or pushed from the opening.

Other prior art electrical light fixture assemblies are shown in the following U.S. Pat. No. 2,491,742 to Lein; U.S. Pat. No. 3,118,558 to Stuessel et al; U.S. Pat. No. 3,848,764 to Saig; U.S. Pat. No. 3,963,204 to Liss; U.S. Pat. No. 4,000,874 to Finley et al; U.S. Pat. No. 4,605,816 to Jorgensen et al; U.S. Pat. No. 4,666,055 to Lewis; and U.S. Pat. No. 4,874,905 to Schnell et al.

However, none of the inventions disclosed above or elsewhere in the prior art provide an electrical light fixture assembly that can be easily used when the opening extending into and thru the ceiling or wall panel is partially or wholly blocked by a pipe, wall or ceiling stud or other component enclosed within the interior portion of the wall or ceiling.

Thus, a need in the electrical art exists to provide an improved electrical light fixture assembly which can be easily mounted in an opening of a wall or ceiling. This invention addresses the need in the art, along with other needs which will become apparent to those skilled in the art once in receipt of this disclosure.

SUMMARY OF THE INVENTION

Accordingly, a primary object of the invention is to provide an electrical light fixture assembly which can be securely positioned within an opening of a panel such as a wall or ceiling panel.

A further object of the invention is to provide an electrical light fixture assembly which can be installed in a panel opening easily and quickly.

A further object of the present invention is to provide an electrical light fixture assembly which is simple an inexpensive to manufacture and has few parts associated therewith.

The foregoing objects are basically attained by providing an electrical light fixture assembly for attachment to a mounting panel having a front surface, a back surface and an installation hole formed therethrough. The assembly comprises a housing including a base having a rearwardly facing surface and having at least one knockout disc formed therein and a sidewall extending forwardly of the base to define a hollow enclosure having a front opening. When the housing, i.e., the combination of the base and sidewall, is inserted into the installation opening, the rearwardly facing surface of the base of said housing is in substantially the same plane as, i.e., it is coplanar with the back surface of the mounting panel.

A plurality of tab members extend outwardly from the sidewall, the tab members being adjacent to the front opening of the hollow enclosure and engage the front surface of the mounting panel, thus limiting the entry of the housing through the installation hole of the panel.

A stop member is secured to the base for limiting the degree of rotation of an at least one clamp member. Typically the rotation of such clamp member is halted when it contacts the stop member when the clamp member is in a substantially perpendicular position to a line drawn tangentially to the base at the position where said base and said clamp member meet. A rotatable shaft member, accessible from the front of the housing, rotates the at least one clamp member which is secured to the rotatable shaft member that extends rearwardly of the rearward facing surface of the base.

When the rotatable shaft member is rotated, such rotation causes the at least one clamp member to also rotate and thus engage the back surface of the mounting panel, thereby securing the housing to the mounting panel. Continued rotation of the at least one clamp member is limited by the stop member, which prevents the at least one clamping member from further rotation which would disengage it from the back panel.

Other objects, advantages and salient features of the invention will become apparent from the following detailed description, which taken together with the drawings disclose the preferred embodiments of the invention.

BRIEF DESCRIPTION OF THE DRAWINGS

Referring now to the drawings which form part of this disclosure.

DETAILED DESCRIPTION OF THE PREFERRED EMBODIMENTS OF THE INVENTION

Figure 1:
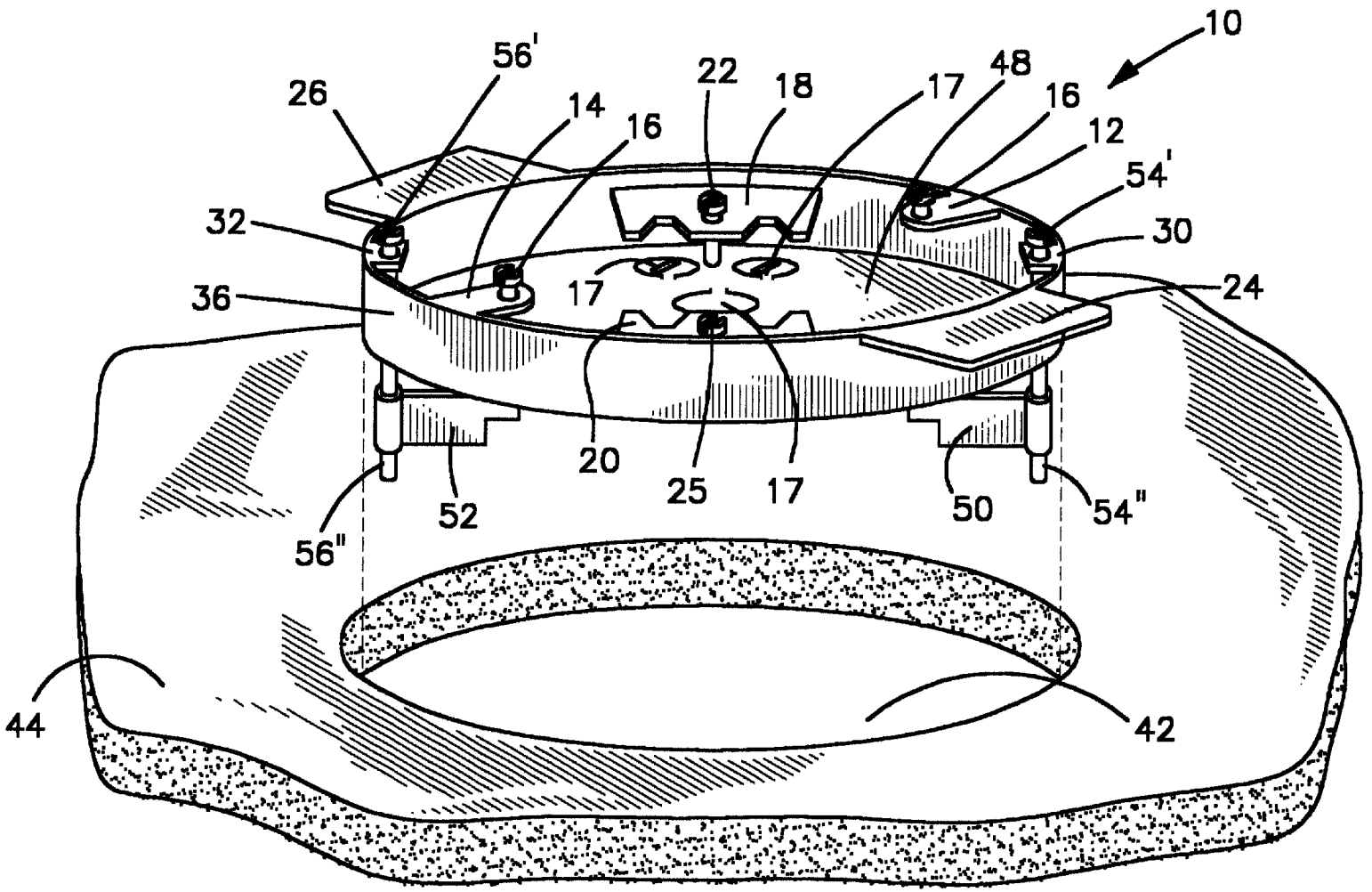
FIG. 1 is an exploded, perspective view of the electrical light fixture assembly in accordance with the present invention before being mounted within an opening formed in a mounting panel.
Figure 2:
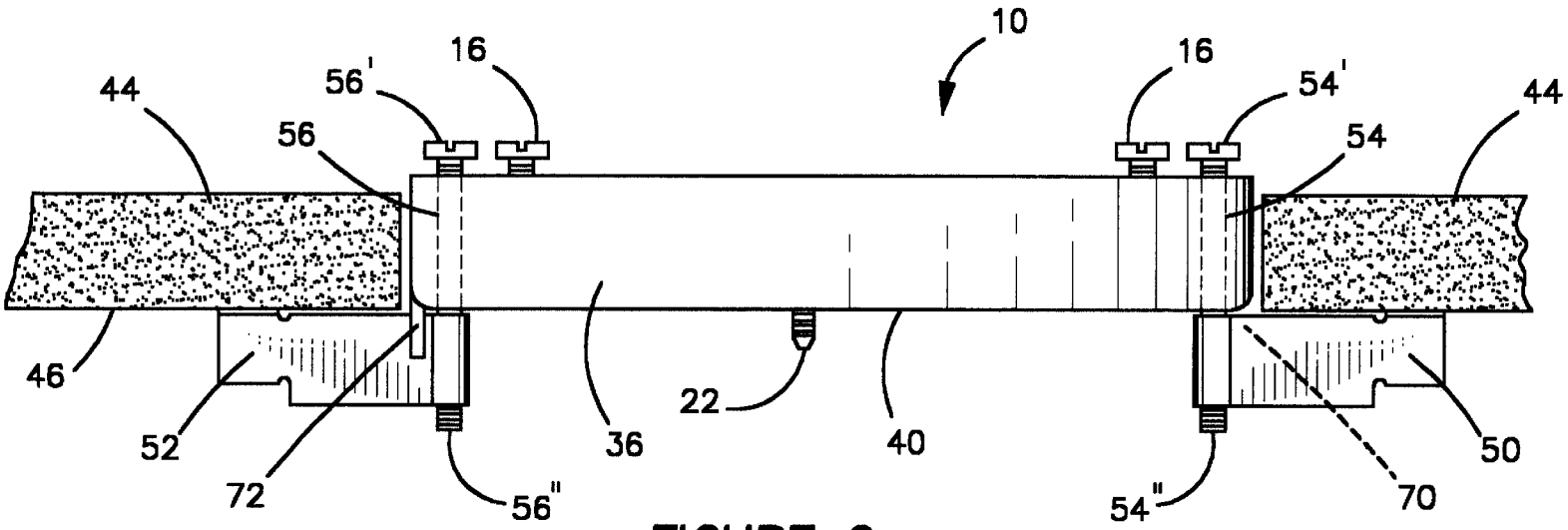
FIG. 2 is a side elevational view of the electrical light fixture assembly of FIG. 1 after being mounted within the opening in the mounting panel.

As can be seen in FIGS. 1 and 2, the electrical light fixture assembly 10 is illustrated in accordance with the present invention, which is mounted within the opening 42 formed in the mounting panel 44. An electrical device (not shown) such as a light fixture can be secured to the light fixture assembly by using receptacle mounting tabs 12 and 14 within the electrical light fixture assembly 10 via mounting screws 16 in a conventional manner. Wire locking plate members 18 and 20, can be used to lock in place (using screws 22 and 25) electrical current carrying wires that enter the electrical light fixture assembly thru the opening created in the base of the assembly when one or more of the knockout discs 17 is removed.

Figure 3:
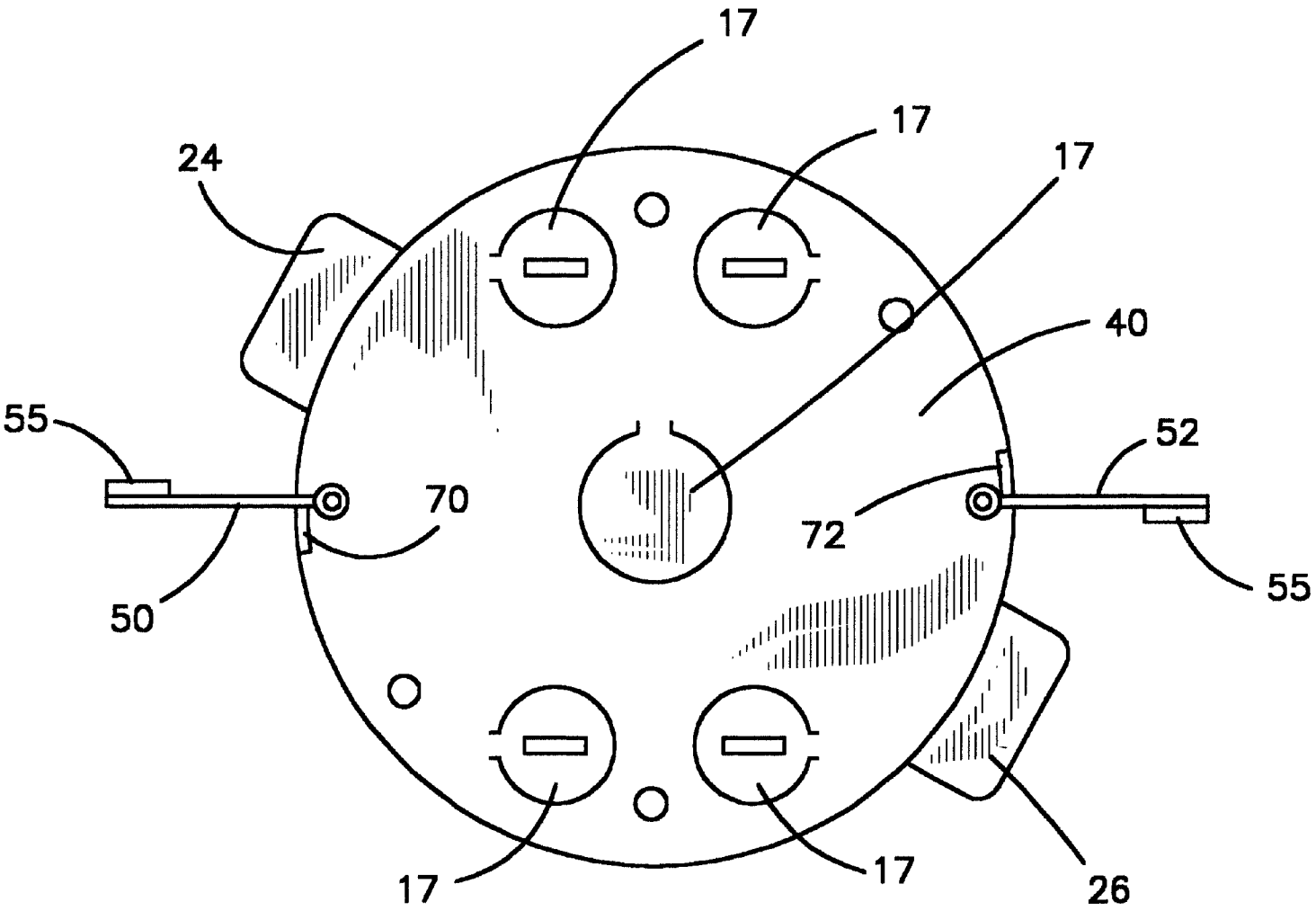
FIG. 3 is a rear elevational view of the electrical light fixture assembly of FIGS. 1 and 2.

As can be seen in FIGS. 1 and 3, the electrical light fixture assembly 10 has a pair of tab members 24 and 26 adjacent the front opening of the assembly that are integrally formed on opposite sides of sidewall 36 of the electrical light fixture assembly for positioning the electrical light fixture assembly 10 within opening 42 to prevent the electrical light fixture assembly from being pushed thru the opening 42 and past the back surface 46 of mounting panel 44 and into the interior of the wall or ceiling. The tab members are substantially perpendicular to side wall 36. Additionally, once the electrical light fixture assembly 10 has been mounted within the panel opening 42, the tab member 24 and 26 will also prevent the electrical light fixture assembly 10 from rocking from side to side. In this respect, and as best shown in FIG. 1, tab members 24 and 26 form two spaced apart contact areas for the front surface of mounting panel 44. It will become apparent to one skilled in the art upon reviewing this disclosure that tab members 24 and 26 can be modified in a variety of ways for engaging the opening 42, for example such as in the form of a single tab member extending completely around the perimeter of the electrical light fixture assembly 10 or as multiple tab member. Thus, the electrical light fixture assembly 10 can be readily installed in mounting panel opening 42 easily and quickly.

The housing (the combination of base 40 and sidewall 36) of electrical light fixture assembly 10 is preferably formed as a one-piece unitary, metal-stamped member, i.e., sheet steel. Similarly, electrical light fixture assembly 10 can be formed as a one-piece unitary, integrally molded member from suitable non-metallic materials, such as a rigid thermoplastic material, i.e., polyvinyl chloride, or a rigid thermoset material, i.e., phenolic resin.

The electrical light fixture assembly 10 is substantially circular in the front and rear elevational view (see FIGS. 1 and 3) and is a housing that includes a base 40 having a rearwardly facing surface, a sidewall 36 and an open front 48. Base 40, which may be of a circular configuration, forms an angle of about 90° with, i.e., is substantially perpendicular to sidewall 36, which extends around the circumference of base 40. Open front 48 allows one or more electrical devices, such as a light fixture (not shown) to be mounted within electrical light fixture assembly 10.

As noted above, tab members 24 and 26 extend outwardly of the front opening and are perpendicular to sidewall 36. (Note, since the preferred embodiment of the present invention is an assembly that is substantially round, what is meant by "perpendicular" is that the position occupied by the part of the assembly being discussed is approximately 90° to a line drawn tangent to the surface of the sidewall at the point where the sidewall and the part of the assembly intersect). Rotatable shaft-mounting tab members 30 and 32 are adjacent the front opening 42 and extend inwardly, and perpendicularly from sidewall 36.

In the subsequent disclosure of the electrical light fixture assembly 10, reference is made to clamp members, rotatable shaft members and the rotatable shaft-mounting tab members. These members form a part of the electrical light fixture assembly 10 and are used to secure the electrical light fixture assembly to the interior surface 46 of mounting panel 44. They are sometimes referred to herein as the "clamp assembly". Further, while these members may be referred to singularly in the disclosure, the electrical light fixture assembly 10 of the instant invention can have more than one of these clamp assemblies, e.g., two of such assembly's are shown in FIGS. 1, 2 and 3.

Rotatable shaft member forward extensions 54' and 56' pass rearwardly thru the rotatable shaft-mounting tab members 30 and 32 to become rotatable shaft members 54 and 56 and thence thru base 40 to form rotatable shaft members rearward extensions 54" and 56" located at the rearwardly facing surface of the base 40. Secured to the rotatable shaft member rearward extensions are clamp members 50 and 52, i.e., positioned rearwardly of the base 40 are clamp members 50 and 52.

As seen in FIG. 1, the electrical light fixture assembly 10 of the present invention has the rotatable clamp members 50 and 52 shown in the retracted position, such facing inwardly from sidewall 36 and adjacent to the rearwardly facing surface of base 40. This is the favored position of such rotatable clamp members 50 and 52 prior to mounting the electrical light fixture assembly into panel opening 42. After insertion of the electrical light fixture assembly 10 into the mounting panel opening 42, the rotatable shaft forward extensions 54' and 56' (which in the preferred embodiment are in the form of slotted heads and extend outwardly beyond the forward plane of the assembly) are turned clockwise, thereby rotating the rotatable shaft members 54 and 56 and rotatable shaft rearward extensions 54" and 56". Simultaneously clamp members 50 and 52 also turn in the clockwise direction and rotate to extend outwardly from sidewall 36 so as to engage the back surface 46 of the mounting panel 44. See FIG. 2. As noted above, clamp members 50 and 52 are secured to rotatable shaft members rear extensions 54" and 56". As can be best seen in FIG. 3, the continued rotation of clamp members 50 and 52 past the point where such clamp members extended beyond the point of being substantially perpendicular (90°) to sidewall 36 is prevented by stop members 70 and 72.

In a preferred embodiment of the present invention and as specifically shown in FIG. 2, rotatable clamp members 50 and 52 are threadedly secured to the rotatable shaft member rearward extensions 54" and 56". Rotatable shaft mounting tab members 30 and 32 have threaded holes for receiving the rotatable shaft member forward extension 54' and 56'. In such an embodiment, the clamp members 50 and 52 may be located on rotatable shaft member rearward extensions 54"

and 54" at a distance and spaced apart from the base 40 prior to being inserted into mounting panel opening 42. After insertion into the mounting panel, the clockwise rotation of rotatable shaft member forward extensions 54' and 56', rotatable shaft members 54 and 56 and rotatable shaft members rearward extensions 54" and 56" causes the clamp members 50 and 52 to rotate to the extended position and to contact stop members 70 and 72. Stop member 70 in FIG. 2 is at a such position as to inhibit a clear view of it in the figure. However, it's location is indicated by the dashed line of FIG. 2. Continued rotation of rotatable shaft members causes the clamp members 50 and 52 (now in their extended position) to be drawn linearly along the axis of the rotatable shaft member rearward extensions 54" and 56" toward base 40 and into engagement with the back surface 46 of the mounting panel 44, such movement being halted when the clamp members engage the back side of mounting panel 42.

Figure 4C:
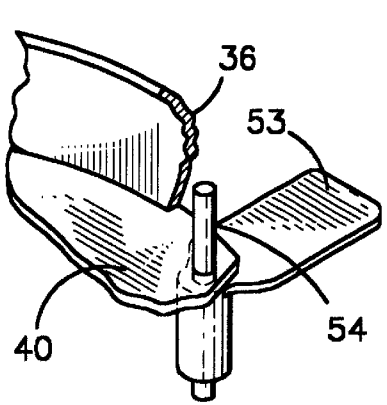
FIG. 4*c* is an exploded, perspective view of a flat plate clamp member of the electrical fixture assembly of FIGS. 1–3.

As can be readily seen in FIG. 2, the electrical light fixture assembly 10 of the present invention has base 40 which has a rearwardly facing surface that is coplanar with the back surface 46 of mounting panel 44. As such, in situations where openings cut into such a panel, such as opening 42, unexpectedly reveal pipes, plates, or other element of the building structure that had been covered over when the mounting panel was installed, the electrical light fixture assembly 10 is readily employed to achieve the purpose of similar electrical assemblies that are unusable because their deeper construction that prevents their use without a substantial effort to modify the impeding element. However, in some cases the impeding element may be so close to the mounting panel that clamping members 50 and 52 shown in FIGS. 1 and 2 may need to be fashioned in flat sheet form, one of which 53 is shown in FIG. 4*c*. As such, and in this embodiment, when such (flat plate) clamp members are in their extended position, they are substantially coplanar with the rearward facing surface of base 40 and with the back surface 46 of mounting panel 44.

Similarly, and referring to FIG. 1, also adjacent the front opening 42 and extending inwardly and perpendicular to sidewall 36 are wire locking plate members 18 and 20. These wire locking plate members 18 and 20 are used to secure electric current-carrying wires that enter the assembly from the outside (not shown). Wires positioned between the wire locking plate members 18 and 20 and base 40 are locked in place with screws 22 and 25. A wire locking plate is typically necessary when the electrical light fixture assembly 10 is used to bring electrical current into the assembly (typically by removing one or more knockout disc 17 and inserting the electrical current carrying wire(s) thru the opening thus formed) and ultimately to power the light fixture for which the electrical fixture assembly is used.

Additionally, and also mounted adjacent to and extending perpendicular to inwardly of the front opening 42 are receptacle mounting tabs 12 and 14 as noted above.

As already noted , these may be of sheet metal or of a suitable non-metallic material. The clamping members also can be manufactured from either of these materials, consistent with suitable design criteria. Further, as shown more clearly in FIGS. 1 and 4, the clamping members may be fabricated to include a part that is fashioned at a 90° angle to the main body of the clamp member, forming a clamp member tab 55. See FIGS. 4*a* and 4*b*). When the clamping member configured to include a clamp member tab 55 is fully extended and in engagement with the back surface of the mounting panel, such clamp member tab 55 gives additional security in securing the electrical light fixture assembly to the mounting panel.

Figure 4B:
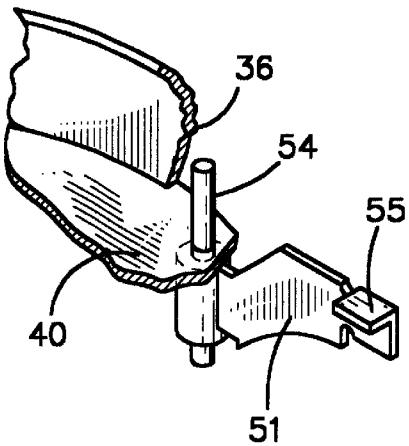
FIG. 4*b* is an exploded, perspective view of a clamp member where the tab member extends forward of the plane of the base of the electrical fixture assembly of FIGS. 1–3.
Figure 4A:
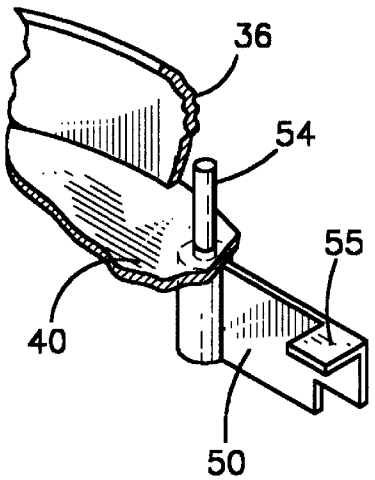
FIG. 4*a* is an exploded, perspective view of a clamp member of the electrical fixture assembly of FIGS. 1–3.

As a further embodiment of the present invention, when in the extended positions as shown on FIG. 4*b,* the part of the at least one clamp member with clamp member tab 55 may extend out of the plane and forwardly of the back surface of the base 40 of the lighting fixture assembly to form a clamp member 51. Such an embodiment is particularly useful when the electrical fixture assembly is being mounted in a mounting panel having an uneven rearward facing surface, i.e., the surface 46 of mounting panel 44 may lie out of the plane of the rearward facing surface of base 40.

I claim:

1. An electrical light fixture assembly for attachment to a mounting panel having a front surface, a back surface and an installation opening formed therethrough, the assembly comprising:

a) a housing including a base having a rearward facing surface and having at least one knockout disc formed therein and a sidewall extending forwardly of the base to define a hollow enclosure having a front opening wherein when the housing is inserted into said installation opening, the rearward facing surface of the base of said housing and the back surface of the mounting panel are substantially coplanar;

b) a plurality of tab members extending outwardly of the sidewall, said tab members being adjacent to the front opening, for engaging the front surface of the mounting panel and limiting the entry of the housing through the installation opening of the panel;

c) a rotatable shaft member accessible from the front opening of the housing and having a part that extends rearwardly of the rearward facing surface of the base, at least one clamp member rotatably secured to the rearwardly extending part of the rotatable shaft member and a stop member that is secured to the rearward facing surface of the base and extends laterally outwardly from said base for limiting the degree of rotation of the at least one clamp member;

d) wherein rotation of the rotatable shaft member causes the at least one clamp member to rotate, engaging said stop member when such clamp member is at a substantially perpendicular position to a line drawn tangentially to the base at a position where said base and said clamp member meet, and engage the back surface of the mounting panel, thereby securing the housing to the mounting panel.

2. The electrical light fixture assembly according to claim 1 wherein said base is of a circular configuration.

3. The electrical light fixture assembly according to claim 1 wherein said rotatable shaft member extends outwardly beyond the front opening of the hollow enclosure of said housing of the electrical light fixture assembly, said rotatable shaft member terminating in a slotted end.

4. The electrical light fixture assembly according to claim 1 wherein said at least one clamp member is threadedly secured to said part of the rotatable shaft member that extends rearwardly of the rearward facing surface of the base.

5. The electrical light fixture assembly according to claim 4, wherein continued rotation of said rotatable shaft member causes said at least one clamp member to be drawn linearly along the part of the rotatable shaft member that extends rearwardly of the rearward facing surface of the face, and into engagement with the back surface of the mounting panel.

6. The electrical light fixture assembly according to claim 1 wherein said at least one clamp member is in the form of a flat sheet.

* * * * *